US005469247A

United States Patent [19]

Cheng et al.

[11] Patent Number: 5,469,247

[45] Date of Patent: Nov. 21, 1995

[54] TONED MEMBER CLEANING BY ELECTRIFIED ROLLER

[75] Inventors: Kuangti T. Cheng; Ashok Murthy; Jeanne M. Saldanha-Singh; Pramod K. Sharma, all of Lexington, Ky.

[73] Assignee: Lexmark International, Inc., Greenwich, Conn.

[21] Appl. No.: 270,715

[22] Filed: Jul. 5, 1994

[51] Int. Cl.[6] ..... G03G 21/00

[52] U.S. Cl. ..... 355/296; 355/200; 355/271

[58] Field of Search ..... 355/200, 271, 355/272, 273, 274, 296, 301, 302, 303

[56] References Cited

U.S. PATENT DOCUMENTS

| | | | |
|---|---|---|---|
| 3,687,541 | 8/1972 | Aser et al. | 355/274 |
| 4,743,939 | 5/1988 | Dulmage et al. | 355/274 |
| 4,791,455 | 12/1988 | Yamamoto et al. | 355/303 |
| 5,034,778 | 7/1991 | Levanon et al. | 355/296 |
| 5,087,939 | 2/1992 | McDougal | 355/200 |
| 5,117,261 | 5/1992 | Sakai et al. | 355/272 X |
| 5,119,144 | 6/1992 | Hada et al. | 355/303 |
| 5,241,343 | 8/1993 | Nishio | 355/219 |
| 5,268,717 | 12/1993 | Imaizumi | 355/272 X |

*Primary Examiner*—Sandra L. Brase
*Attorney, Agent, or Firm*—John A. Brady

[57] ABSTRACT

Cleaning roller (7) contacts intermediate transfer roller (4), each rotating at the same surface speed to avoid rubbing. The cleaning roller has an electric potential sufficient to remove toner from the transfer roller to clean it. Silicone oil is applied by a roller 29, which is wetted by oil from a oil impregnated wiper (31). The oil facilitates cleaning and reduces wear of the intermediate transfer roller, which is typically soft to facilitate transfer.

12 Claims, 1 Drawing Sheet

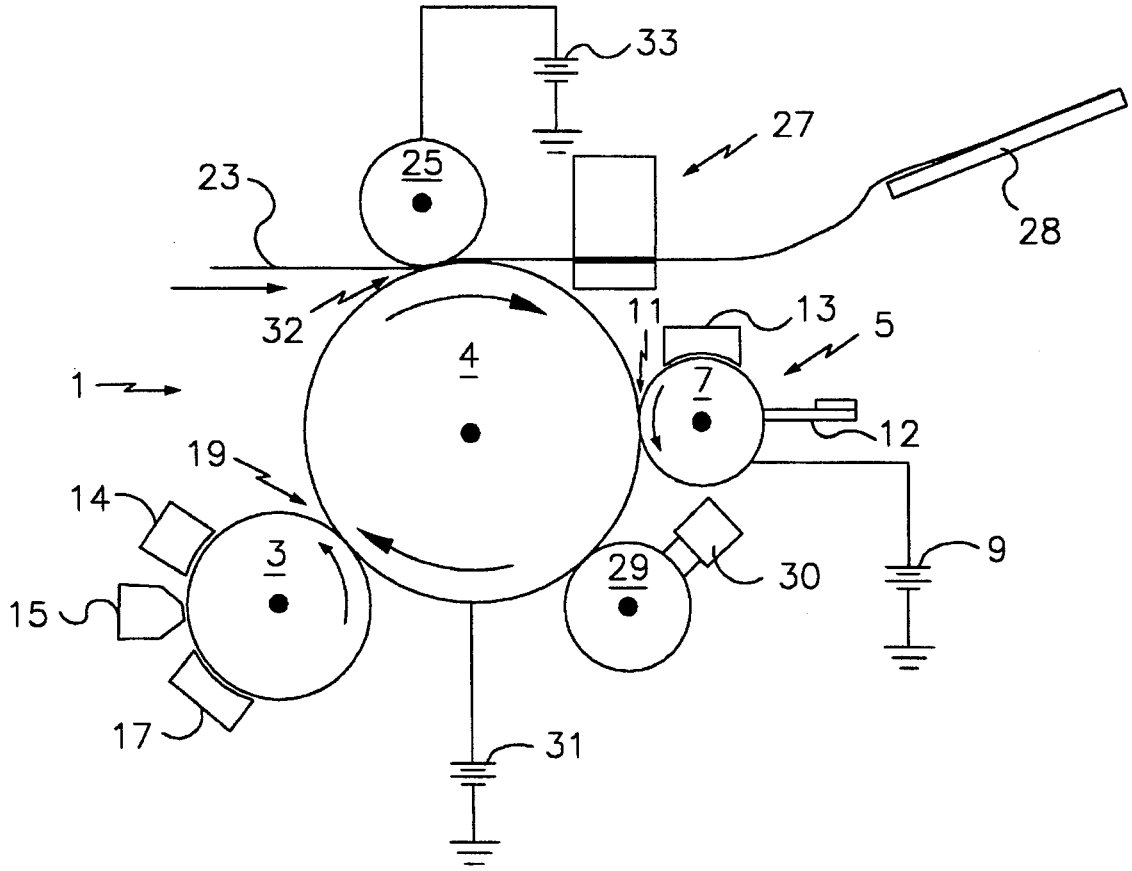
33
27
25
23
28
32
11
13
5
4
1
7
12
19
14
3
29
30
9
15
17
31

TONED MEMBER CLEANING BY ELECTRIFIED ROLLER

TECHNICAL FIELD

This invention relates to electrophotographic imaging and, more specifically, relates to cleaning the toned members, particularly intermediate transfer members, after transfer of a toned image from such members.

BACKGROUND OF THE INVENTION

Ideally, toned images on a transfer member would be fully transferred off and then no subsequent cleaning would be needed. In practice, however, cleaning is common, often by scraping the residual toner off with a blade which contacts the toned surface. When the surface of the toned member is soft, as is typically true for intermediate transfer members, such mechanical cleaning, causes physical wear which shortens the useful life of the toned member.

This invention employs an electrically biased cleaner, the electrical bias being the essential force moving toner from the toned member to an endless cleaning member. Use of electrical bias for removal of toner in cleaning is disclosed in U.S. Pat. Nos. 5,119,144 to Hada et al, 5,241,343 to Nishio and 5,034,778 to Levanon et al (the cleaning roller 56 being only at electrical ground). In the Hada et al disclosure a second, pushing electrical bias is produced from the inside of the photoconductor.

Such prior art appears to rely significantly on some physical rubbing action of the cleaning member. Thus, in the Hada patent the cleaning member is shown as bristles and in the Nishio patent the cleaning member is a foam roller. In Levanon et al the cleaning roller 56 is rotated to move opposite to the surface of the photoconductor being cleaned. No prior art is known to produce highly complete cleaning with minimal wear on the toned member as does this invention.

The wick applicator of silicone oil of the preferred embodiment of this invention is identical in structure with that used to apply silicon oil otherwise identical to that of the preferred embodiment of this invention but of a higher nominal viscosity to a transfer roller in prior art printers sold by the assignee of this invention. Since such transfer roller is heated, the actual viscosity of the oils in this invention and of the prior art are intended to be substantially identical. That prior art use, however, does not involve cleaning employing an electrified member.

DISCLOSURE OF THE INVENTION

In accordance with this invention, an endless, smooth-surfaced cleaning member is moved with the toned member so as to have minimum or zero relative movement between the cleaning member and the toned member. During or after each cleaning cycle a silicon oil is applied to the toned member. The cleaning member is semiconductive and electrified to a potential to strongly attract toner from the intermediate transfer roller.

Wear of the cleaned member is minimal and the cleaning is highly effective and complete, The cleaning roller does not contribute to heating of the transfer roller and can be a cooling member if designed with air flow. After a paper jam or other failure to transfer most image from the intermediate transfer roller, the hot pressure roller's electrical bias may be switched to same sign as the toner charge to film toner on the intermediate roller, with the cleaning mechanism as described cleaning the filmed image.

BRIEF DESCRIPTION OF THE DRAWING

The details of this invention will be described in connection with the accompanying drawing in which FIG. 1 is illustrative of a preferred imaging apparatus.

BEST MODE FOR CARRYING OUT THE INVENTION

The drawing illustrates an electrophotographic imaging apparatus 1, such as a laser printer having a photoconductive drum 3 with a firm surface, such as a surface of a polycarbonate or polyestercarbonate binder with charge transporting additives, as may be entirely conventional. Drum 3 transfers toned images to a transfer roller 4. Transfer roller 4 has a somewhat soft surface, such as a surface of polyurethane with a carbon black or other conductive particles to be semiconductive. Transfer roller 4 is somewhat resilient because it will transfer a toned image to paper or other rough substrate, which is accomplished more completely when the surface of roller 4 can conform during transfer with the surface of the substrate.

Cleaning is accomplished at a cleaning station 5 which has a cleaning roller 7 having a very smooth, somewhat yielding surface. Roller 7 may be entirely of elastomer, such as polyurethane, having a filler such as carbon black to achieve a conductivity of 5×10E7 to 5×10E9. A source 9 of DC electrical potential is connected to roller 7 and thereby brings the surface of roller 5 to the potential of source 9. Roller 4 is rotated by a motor (not shown) and roller 7 is rotated by the same or a different motor (not shown) or preferably driven by friction from roller 4 so that the surfaces at their point of contact 11 are relatively stationary with respect to each other. A cleaning blade 12 located away from point 11 contacts roller 7 to scrape toner from roller 7 and the surface of roller 7 is also dried and further cleaned by a dry wiper 13 before point 11.

Positioned at stationary locations around drum 3 are certain members which may be entirely conventional with respect to this invention and are therefore shown illustratively. Drum 3 moves counter clockwise in the drawing to bring a location on the surface of drum 3 to a charging station 14; then to a laser imaging station 15 positioned past the charging station which applies light in an image pattern to the charged surface of drum 3, thereby discharging drum 3 in the pattern of that image; then to a developing station 17, which in the preferred embodiment applies a liquid toner, positioned past imaging station 15; then to a transfer nip 19 positioned past developing station 17. At transfer nip 19 the toned image is transferred to intermediate transfer roller 4. The image is subsequently transferred to paper 23 or other final substrate, at the nip with an impression roller 25, and the image is fixed, as by heat, at a fixing station 27. Paper 23 is ultimately delivered out of printer 1 to a tray 28 for access to an operator of printer 1.

Past the cleaning roller 7 in contact with transfer roller 4 is applicator roller 29. Roller 29 has a perfluoroethylene surface which contacts the surface of transfer roller 4. A wick 30 containing silicone oil (polydimethylsiloxane of 10,000 cs viscosity) applies a thin layer of the oil to the surface of roller 29. That is transferred to roller 4 at the point of contact between rollers 29 and 4. Wick 30 preferably is a felt bar of approximately ¼ inch in the tangent plane to roller 29, ½ inch perpendicular to roller 29 and extending across the entire length of roller 29. The felt of wick 30 is held in a simple, conforming frame which surrounds the felt except for an outer part which actually contacts roller 29. The felt is soaked with the oil prior to installation in printer 1 and the wick 30 is replaced periodically with a new one, such as each time the photoconductor drum 3 is changed. Typical usage before changing is 30,000 images. (The wick structure and action just described, except with a higher viscosity oil, is the same as is used to apply the oil to the hard fuser roller of prior art printers sold by the assignee of this invention.)

The silicone oil is electrically neutral in that it is both non-conductive and believed not to be significantly dielectric. This does not block the electric field from roller 7, and toned image is transferred by the force of that field from transfer roller drum 4 to cleaning roller 7, as is conventional. Although silicon oil is basically a lubricant, roller 4 continues to be electrified from potential source 31, which continues to hold the toned image in place. During transfer to paper 23 at nip 32 of roller 4 and transfer roller 25, transfer roller 25 has a still higher potential from potential source 33 which moves toner from roller 4 to the paper. Similarly, potential source 9 is higher in potential than potential source 31 to attract toner from transfer roller 4. Toner is at the opposite potential of potential sources 9, 31 and 33.

Wick 30 may be located in contact with cleaning roller 7, thereby eliminating applicator roller 29 with only slight loss of cleaning efficiency. After a paper jam or other failure to transfer most image from the intermediate roller 4, the hot pressure roller 25 is kept at the same temperature 100° to 110° C., but its electrical bias is brought to zero or somewhat reversed in sign. This films toner on roller 4, facilitating cleaning by roller 7. Other changes within the spirit and scope of this invention can be anticipated.

What is claimed is:

1. Electrophotographic imaging apparatus comprising a developer station to apply toner to develop electrostatic images into toned images, an endless toned member to receive said toned images and to transfer said toned images to another substrate at a transfer station, an endless cleaning member positioned past said transfer station, said cleaning member having a smooth outer surface in contact with said toned member, a source of electrical potential to bias said cleaning member to remove toner at said toned image to said cleaning member, means to rotate said cleaning member and said toned member at essentially the same surface speed and in the same direction where said toned member and said cleaning member are in contact, and an applicator station to apply an alkyl siloxane oil to said toner member located at or past said cleaning member and prior to said toned member receiving said toned images.

2. The electrophotographic imaging apparatus as in claim 1 also comprising a cleaning blade contacting said cleaning member away from said endless toned member to scrape toner from said cleaning member.

3. The electrophotographic imaging apparatus as in claim 2 in which said applicator station comprises a perfluoroalkyl resin coated roller in contact with said toned member and means to apply said oil to the surface of said perfluoroalkyl resin coated roller, said means to apply oil being spaced from the location of contact of said resin coated roller and said toned member.

4. The electrophotographic imaging apparatus as in claim 3 in which said applicator station is located past said cleaning member.

5. The electrophotographic imaging apparatus as in claim 3 in which said toned member is an intermediate transfer member.

6. The electrophotographic imaging apparatus as in claim 4 in which said toned member is an intermediate transfer member.

7. The electrophotographic imaging apparatus as in claim 2 in which said applicator station is located past said cleaning member.

8. The electrophotographic imaging apparatus as in claim 7 in which said toned member is an intermediate transfer member.

9. The electrophotographic imaging apparatus as in claim 2 in which said toned member is an intermediate transfer member.

10. The electrophotographic imaging apparatus as in claim 1 in which said applicator station is located past said cleaning member.

11. The electrophotographic imaging apparatus as in claim 10 in which said toned member is an intermediate transfer member.

12. The electrophotographic imaging apparatus as in claim 1 in which said toned member is an intermediate transfer member.

* * * * *